United States Patent [19]

Lüebbers

[11] Patent Number: 4,487,127

[45] Date of Patent: Dec. 11, 1984

[54] PERCUSSION FUSE

[75] Inventor: Willi Lüebbers, Trittau, Fed. Rep. of Germany

[73] Assignee: Rheinmetall GmbH, Duesseldorf, Fed. Rep. of Germany

[21] Appl. No.: 447,881

[22] Filed: Dec. 8, 1982

[30] Foreign Application Priority Data

Dec. 12, 1981 [DE] Fed. Rep. of Germany ..... 3149346

[51] Int. Cl.[3] ..... F42C 1/00

[52] U.S. Cl. ..... 102/253; 102/222; 102/272

[58] Field of Search ..... 102/272, 275, 247, 222, 102/230, 239

[56] References Cited

U.S. PATENT DOCUMENTS

| | | | |
|---|---|---|---|
| 190,861 | 5/1877 | Hotchkiss | 102/275 |
| 785,846 | 3/1905 | Wieser | 102/231 |
| 1,509,329 | 9/1924 | Woodberry | 102/272 |
| 3,576,165 | 4/1971 | Gawlick et al. | 102/259 X |
| 3,995,556 | 12/1976 | Lübbers | 102/272 X |
| 4,036,145 | 7/1977 | Lübbers | 102/247 |

*Primary Examiner*—David H. Brown

[57] ABSTRACT

An improved construction for a percussion fuse. The fuse function has a firing pin rigidly mounted in an ignition head an adapted to coact with a percussion cap mounted in an impact member. This impact member is securedly maintained in a first position by means of at least one blocking sphere which is partially mounted in an annular groove of the impact member and partially mounted in a bore of the cylindrical forward portion of the percussion fuse body. A movable inertial sphere is disposed in a chamber between the impact member and the ignition head. In order to improve the fail-safety there is mounted in this chamber a housing between the impact member and ignition head which is coaxially movable with respect to the firing pin. When the projectile is accelerated forwardly the housing moves against the impact member and the movable inertial sphere is clamped between the impact member and housing to thereby prevent a further relative motion between firing pin and percussion cap and to thereby prevent detonation of the percussion cap. During normal deceleration prior to target impact, the housing moves back from the impact member and allows the inertial sphere to roll into the annular chamber of the housing. This allows the impact member to move forward and thereby allows the percussion cap to impact the firing pin when the projectile impacts the target.

6 Claims, 4 Drawing Figures

PERCUSSION FUSE

BACKGROUND OF THE INVENTION

The invention relates to a percussion fuse with a rigidly mounted firing pin and an impact body disposed behind the firing pin which impact body includes a percussion cap. The impact member of the fuse is securely mounted by means of a blocking sphere until the projectile actually leaves the gun barrel muzzle, which blocking sphere engages in a transverse groove of the impact member and is mounted in a bore of the percussion fuse body. The arrangement further includes a movably mounted inertial sphere, and means for clamping this inertial sphere disposed between the impact member and the ignition head, which means clamps the inertial sphere between the impact member and ignition head at premature deceleration of the projectile.

There is disclosed in coassigned U.S. Pat. No. 4,036,145 a percussion fuse assembly which, in case of a premature deceleration of the projectile, clamps the inertial sphere movably arranged between the impact body and the ignition head between two conical surfaces of equal angularity. The first conical surface is rigidly joined to the ignition needle, whereas the second conical surface is disposed in the forward portion of the impact body which impinges on the ignition needle upon impact of the projectile.

A premature deceleration of the projectile can, for example, be caused by means of obstacles, which may be located in the immediate vicinity of the firing position. Such obstacles can take the form of tree branches and leaves, in particular when the firing position is camouflaged. As a result of the premature deceleration of the projectile the fail-safe operation is inhibited which, in the worst case, basis, can lead to the service personnel being placed in danger by means of a premature detonation of the projectile.

With the known percussion fuses, in which a freely movable inertial sphere is clamped between two conical surfaces at premature deceleration, there was not attained in all cases a sufficiently satisfactory fail-safe operation. This was attributed to the fact that, as a result of intense vibrations which occur during the firing and acceleration phase of the projectile, the inertial sphere could slide out of its clamped position and as a result could no longer prevent the initiation of an ignition process.

SUMMARY OF THE INVENTION

It is an object of this invention to provide a new improved type of percussion fuse of the afore-described type which provides a better fail-safe operation.

BRIEF DESCRIPTION OF THE DRAWING

The invention is further set forth in the following detailed description taken in conjunction with the appended drawing, in which.

DETAILED DESCRIPTION

Figure 1:
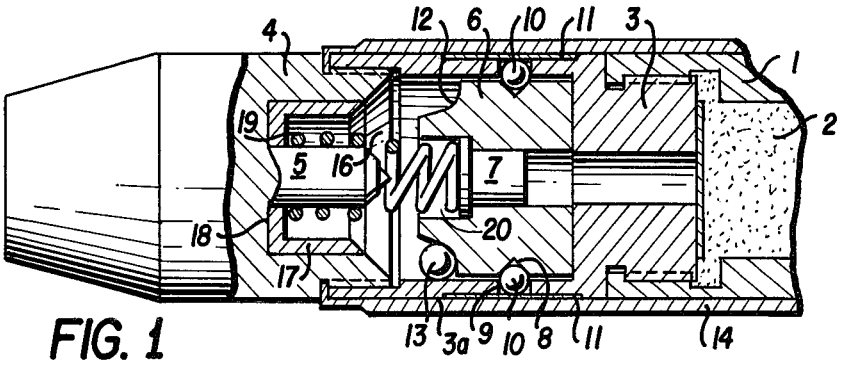
FIG. 1 illustrates a percussion fuse in longitudinal section prior to firing of the projectile in which the percussion fuse is mounted.

The projectile body 1 contains a smoke-explosive charge 2 as well as a percussion fuse body 3 which is threadably mounted on the projectile body 1. This percussion fuse body 3 has mounted in its forward open end an ignition head 4 which covers the percussion fuse body 3. There is rigidly mounted within the ignition head 4 a firing pin 5. There is mounted in the percussion fuse body 3 in confrontational relationship with respect to the firing pin, a percussion cap 7 within the impact member 6. The latter member 6 is slidably mounted within the percussion fuse body 3, but this impact member 6 is maintained in a predetermined position until target impact or until impacting of the projectile on an obstacle while in flight. There is provided on the peripheral surface of the impact member 6 a V-shaped annular groove 8 (that is a groove having a triangularly shaped cross-section), which is confronted by two bores 9, mutually angularly displaced from each other by 180 degrees, which bores are located at diametrically opposite sides of the forwardly extending cylindrical portion 13*a* of the percussion fuse body 3.

In the passages formed by the annular groove 8 and the bores 9 there are disposed blocking spheres 10, the diameters of which correspond to those of the bores 9. A portion of the exterior surface of the cylindrical portion 13*a* of the projectile fuse body 3 is covered by means of a cylindrical sheet 11 of destructible foil material in order to prevent the spheres 10 from slipping out of the bores 9. This sheet 11 may only partially cover the cylindrical peripheral surface of the cylindrical portion 3*a* or may completely surround it.

The sheet 11 can be made of an easily destructible foil material. In the forward portion of the impact member 6, which confronts the firing pin 5, there is provided an annular recess 12 for receiving at least an inertial sphere 13, which sphere is freely movable in the hollow chamber 16 and can come to rest in an annular chamber 15.

In view of the fact that the percussion fuse of the invention is to be used with cartridge-ammunition, the neck of the cartridge casing 14 surrounds the projectile body 1 and the percussion fuse body 3 forwardly up to the height of the ignition head 4. The cartridge casing is drawn in at its forward end and is fixedly clamped by means of the screwed-in ignition head 4.

A cup-shaped housing 17 is mounted in the hollow chamber 16 between the impact body 6 and the ignition head 4 coaxially relative to the firing pin 5, which housing 17 is movable in the chamber 16 along the longitudinal axial direction. This housing 17 has a bottom 18 which confronts the bottom 22 of the hollow chamber 16 and has a central bore in this bottom 18 through which the firing pin 5 projects so that the housing 17 is coaxially and centrally disposed in the chamber 16, whereby the housing 17 is movable, slidably riding on the firing pin 5. The housing 17 is biased by means of a coil spring 19 which is disposed between the bottom 18 of the housing 17 and the impact member 6. This spring 19 urges the housing 17 against the bottom 22 of the hollow chamber 16. One end of the coil spring 19 loosely rides over the firing pin 5 on which it is coaxially mounted and abuts against the bottom 18 of the housing 17, whereas the other end of the coil spring is disposed in a recess 20 coaxially arranged in the impact body 6. The housing 17 slidingly matingly abuts with its exterior peripheral surface on the inner wall surface 21 of the ignition head 4 and is slidably mounted therein so that it is securely guided in the longitudinal axial direction of the assembled arrangement.

MANNER OF OPERATION

Figure 3:
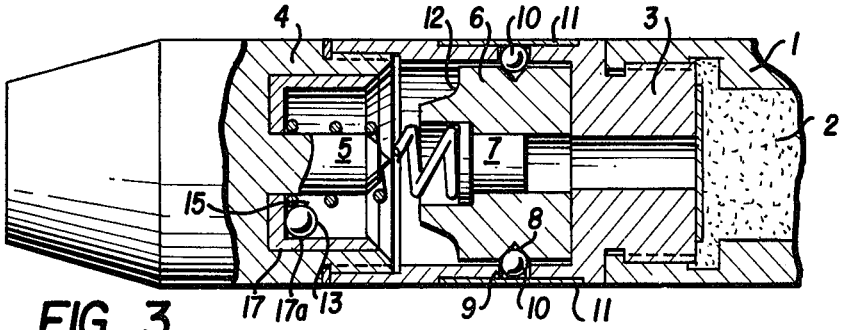
FIG. 3 illustrates the percussion fuse of FIG. 1, also in longitudinal section, during the flight phase on the projectile after normal deceleration.

The projectile having the percussion fuse of the instant invention is more safe to transport, more safe to load, more safe to be fired and more safe to recoil. The manner of operation of the blocking spheres 10 will not be described in detail, since the manner of operation of such blocking spheres forms part of the state of the art (see for example co-assigned U.S. Pat. Nos. 3,995,556 and 4,036,145). FIG. 1 illustrates the percussion fuse in longitudinal section prior to firing. Immediately after firing the only significant change that has occurred is the separation of the cartridge casing 14 from the percussion fuse body 3, the ignition head 4 and the projectile body 1. This separation is effected without damaging the foil sheet cover 11. The foil sheet 11 rather protects the inner wall of the cartridge casing 14 from both blocking spheres 10, because the latter remain during the flight of the projectile within the bores 9 of the percussion fuse body 3. As a result of the inertial forces the housing 17 is furthermore moved against the force of the coil spring 19 and opposite to the flight direction along a predetermined path toward the impact member 6. This operational phase is not illustrated in detail in the drawing. During storage and at firing and during the first flight phase the rearward surface of the impact member 6 abuts against the massive percussion fuse body 3. Only during the course of the further flight path does the air resistance cause an increased degree of deceleration of the projectile but not on the inertial sphere 13. The sphere 13 travels, as a result of its moment of inertia, slowly out of the annular recess 12 into the chamber 16 and finally into the annular chamber 15. Once it has reached chamber 15 it is disposed within an annular chamber that is located between the housing 17 and the firing pin 5 (see FIG. 3). The frusto-conical rearwardly and inwardly extending surface 17*a* facilitates the transfer of the inertial sphere 13 from the recess 12 into the annular chamber 15.

Figure 4:
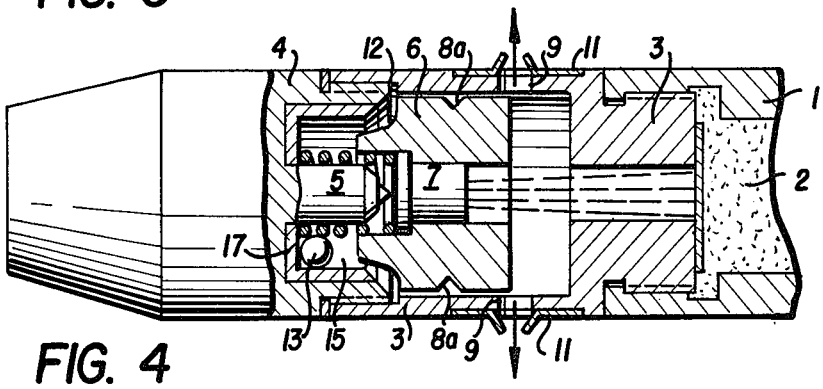
FIG. 4 illustrates the percussion fuse of FIG. 1, also in longitudinal section, after termination of the flight phase at target impact of the projectile.

Upon impact of the projectile on a target the impact member 6 moves forward (see FIG. 4) whereby in view of the forwardly accelerating inclined surface 8*a* the annular groove 8 expels both blocking spheres 10 simultaneously through the bores 9 thereby rupturing the foil sheet 11 so that they can be freely outwardly expelled.

The now freed impact member 6 impacts on the percussion cap 7 while compressing coil spring 19 so that the firing pin 5 penetrates the percussion cap 7 thereby causing an ignition stream to be propelled rearwardly onto the explosive charge 2 for igniting the same.

Figure 2:
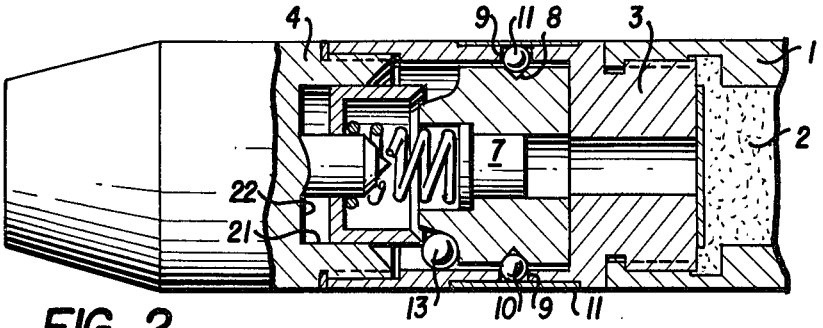
FIG. 2 illustrates the percussion fuse of FIG. 1, also in longitudinal section, after the impact on an obstacle while the projectile and percussion fuse are in the flight phase.

If the projectile should unintentionally impact on an obstacle near the muzzle of the gun, for example a camouflage net, branches, etc. then, due to the sudden deceleration, the impact member 6 slides at simultaneous expulsion of the blocking spheres 10 forwardly, whereas simultaneously the housing 17, as a result of its inertial forces, is still in an intermediate rearward position (see FIG. 2) in which it arrives during firing and during the transverse through the gun barrel. In this case the inertial sphere 13 is reliably clamped between the impact member 6 and the rear edge of surface 17*a* of the housing 17 so that a further relative motion between housing 17 and impact member 6 is prevented and a penetration of the firing pin 5 into the percussion cap 7 is blocked. This arrangement provides, as compared with the state of the art arrangements, a substantially better fail-safe operation. An endangerment of the service personnel due to a premature detonation of the projectile is almost completely eliminated.

Even if the housing 17, due to the forward sliding of the impact member 6 and due to the pressure exerted by the spring 19, is returned to its end position at which the bottom 18 of the housing 17 abuts against the bottom surface 22 of the annular chamber 15, which surface is perpendicular to the longitudinal axial direction, the firing pin 5 cannot impact on the percussion cap 7 because the clamped sphere 13 provides a rigid connection between the impact member 6 and the housing 17 so that no relative movement can occur therebetween and therefore the firing pin 5 can not impinge on the percussion cap 7.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

I claim:

1. In an explosive projectile disposed in a cartridge separable upon firing of the projectile and having a charge-containing projectile body and an ignition head disposed forwardly of and in spaced relation to the projectile body, an improved percussion fuse assembly having a fuse body interconnecting the projectile body and ignition head, said fuse body having a fixed cylindrical portion containing at least one radial bore therethrough, an impact member lockably supported for axial movement in the fixed cylindrical portion between a rearmost rest position and a foremost impact position, the impact member having an annular groove disposed in the periphery thereof in radial alignment with the radial bore of the cylindrical portion when the impact member is in its rearmost position; a first blocking sphere seatable in the radial bore and the annular groove to normally prevent substantial forward motion of the impact member, the impact member having an inwardly and rearwardly extending central recess in the front surface thereof and a percussion cap mounted in said central recess; a firing pin centrally disposed in and extending rearwardly from the rear surface of the ignition head and engageable with the percussion cap when the impact member is in its front most position and a second inertial sphere disposed between the ignition head and impact member and adapted to be clamped therebetween at premature deceleration of the projectile; the improvement comprising, in combination, said ignition head having a rearwardly extending blind bore and said impact member having an annular recess coaxially disposed on its front surface thereof; and a housing slidably movable in the longitudinal axial direction in said blind bore of said ignition head which housing is coaxially mounted relative to said firing pin.

2. The improved percussion fuse assembly as set forth in claim 1, wherein said housing is cup-shaped and has a central bore in its bottom, said firing pin extending rearwardly from the bottom of the blind bore through the central bore of said cup-shaped housing so that the housing can reciprocally ride thereon.

3. The improved percussion fuse assembly as set forth in claim 2, including a coil spring coaxially mounted on the firing pin and having one end engaging the bottom of the cup-shaped housing and the other end engage said impact member in the central recess in the front surface thereof, said coil spring biasing said impact member and housing away from each other.

4. The improved percussion fuse assembly as set forth in claim 3, wherein said blind bore in said ignition head and the exterior surface of said housing have mating diameters so that said housing is slidably movable in said blind bore.

5. The improved percussion fuse assembly as set forth in claim 4, wherein the bottom of said housing and the bottom of said blind bore are disposed normally relative to the longitudinal axis of the percussion fuse assembly, and after termination of the acceleration phase of the assembly said bottom of said housing abuts against said bottom of said blind bore of said ignition head.

6. The improved percussion fuse assembly as set forth in claim 5, wherein the rearmost edge surface of said housing which confronts said impact member has a frusto-conical shape.

* * * * *